US006349906B1

(12) United States Patent
Anderson

(10) Patent No.: US 6,349,906 B1
(45) Date of Patent: Feb. 26, 2002

(54) EARTHQUAKE-PROOF SUPPORT STRUCTURE FOR A BOTTLED BEVERAGE HOLDER AND DISPENSER

(76) Inventor: Ronald C. Anderson, 1832 Eileen Dr., Anaheim, CA (US) 92802

( * ) Notice: Subject to any disclaimer, the term of this patent is extended or adjusted under 35 U.S.C. 154(b) by 0 days.

(21) Appl. No.: 08/629,467

(22) Filed: Apr. 10, 1996

(51) Int. Cl.[7] ..... A47G 23/02
(52) U.S. Cl. ..... 248/146; 248/154
(58) Field of Search ..... 248/154, 638, 248/676, 678, 313, 146, 163.2, 167.2, 177.1; 52/651.04, 651.08, 651.01, 651.11, 652.01; 211/90, 71, 186; 108/42, 101; 222/173, 174

(56) References Cited

U.S. PATENT DOCUMENTS

| | | | | | |
|---|---|---|---|---|---|
| 690,896 | A | * | 1/1902 | Shears | 222/173 X |
| 1,078,804 | A | * | 11/1913 | Royse | 248/163.2 X |
| 2,536,492 | A | * | 1/1951 | Dunn et al. | 248/146 X |
| 2,615,238 | A | * | 10/1952 | Highwood | 248/146 X |
| D249,103 | S | * | 8/1978 | Rodriguez | D6/363 |
| 4,646,944 | A | | 3/1987 | Anderson | |
| 4,955,573 | A | | 9/1990 | Horvath | |
| 5,118,064 | A | * | 6/1992 | Gonsalves | 248/154 X |
| 5,131,133 | A | | 7/1992 | Peterson | |
| 5,232,188 | A | | 8/1993 | Troncone | |
| 5,310,156 | A | | 5/1994 | Matsumura | |
| 5,454,492 | A | * | 10/1995 | Hunter et al. | 222/185.1 |
| 5,586,692 | A | * | 12/1996 | Livengood | 222/185.1 X |
| 5,746,405 | A | * | 5/1998 | Dvorak et al. | 248/146 |

* cited by examiner

*Primary Examiner*—Ramon O. Ramirez
(74) *Attorney, Agent, or Firm*—Greenberg & Lieberman

(57) ABSTRACT

An earthquake-proof beverage bottle support and storage structure adapted to be fastened to a building wall, or other support structure, for securing a bottled beverage container holder and dispenser above a floor, including a shelf for supporting a bottled beverage container holder and dispenser, at least three legs secured to the shelf extending above and below the shelf for supporting the shelf above a floor, and straps with interlocking buckles for securing the beverage bottle to the support system to restrict horizontal movement between the shelf and the beverage bottle. The entire structure can be secured to a wall, or other support structure, by fasteners, or additional straps. Additional shelves and straps can be added to provide storage for additional bottles, whether full or empty.

5 Claims, 2 Drawing Sheets

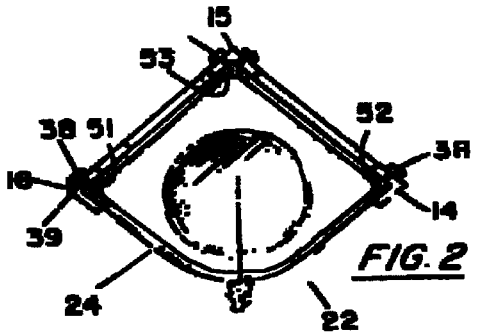
FIG. 2
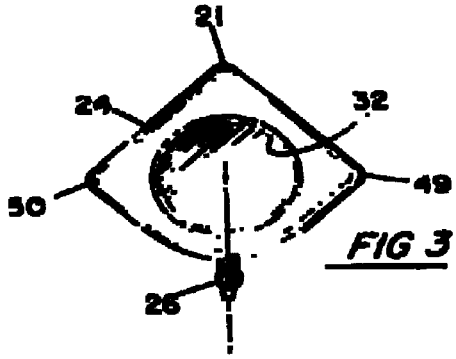
FIG 3
FIG 1
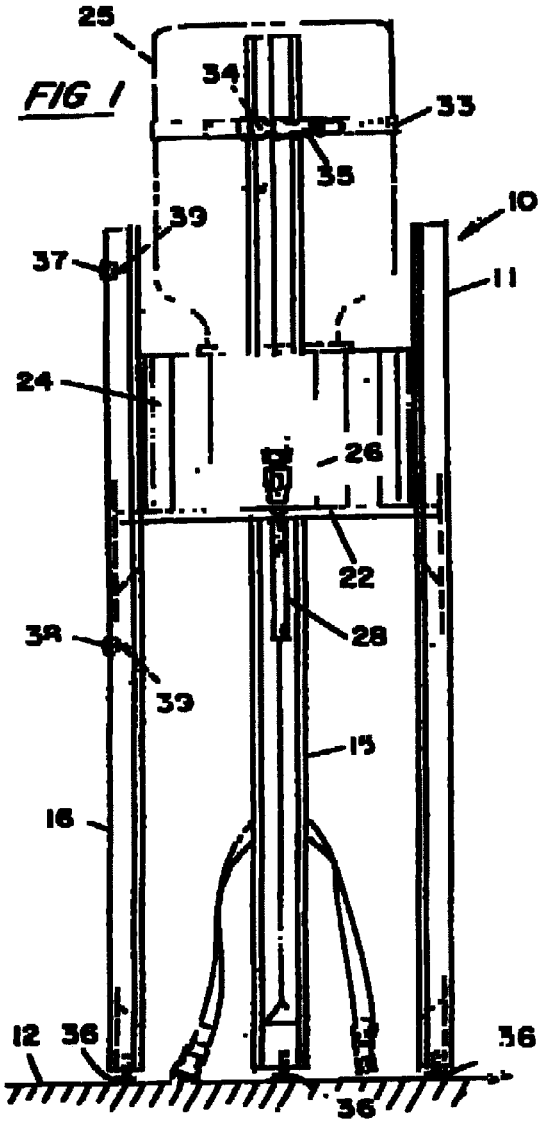
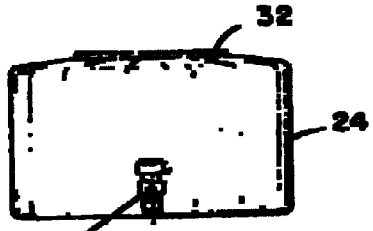
FIG 5
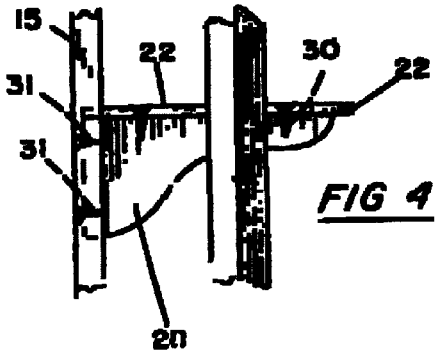
FIG 4
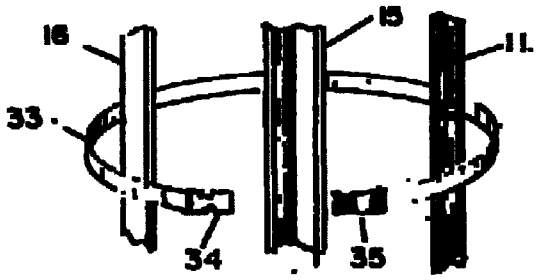
FIG 6

EARTHQUAKE-PROOF SUPPORT STRUCTURE FOR A BOTTLED BEVERAGE HOLDER AND DISPENSER

BACKGROUND OF THE INVENTION (1) Field of the Invention

The invention relates generally to an earthquake-proof beverage bottle support and storage structure for bottled water holders and dispensers, and, more particularly, to an earthquake-proof support structure incorporating means for removably securing such structure to a separate structure for further support.

(2) Description of the Prior Art

Bottled water holders and dispensers used in households and in commercial or office environments are typically tall structures with relatively small foot-prints. Such structures have a high center-of-gravity and, because of this high center-of-gravity, are prone to being tipped over with relatively little side-loading, such as are manifested during the application of horizontally directed forces. During an earthquake or other disaster, such lateral forces can easily reach magnitudes which will cause the unfastened bottled water holder and dispenser to be moved to the point of tipping over. Should this occur, several gallons of water or liquid beverage will flood the floor therebeneath. Or, worse yet, a small child might grab the bottled water holder and dispenser, with a sufficient side-load, cause it to tip over and possibly injuring the child. Depending on the nature of the material forming the floor, flooding the floor can readily and easily cause serious damage to the flooring. Such a quantity of water is definitely not welcome on a wooden floor which tends to be water absorbent which results in warping of the wooden floor. Should the floor be covered with carpeting laid over carpet padding material, such a jute or rebonded pieces of rubber foam material, dumping several gallons of water on it will result in significant damage, due to leeching out of the sizing in the carpeting causing the carpeting to become loose and bunch up. Such carpet bunching produces a rippling effect over the surface of the carpet which acts to engage, or catch, a person's shoes causing the person to trip, and sometimes, fall to the floor. Besides creating traps for the unwary, such flooding augments the rapid production of mildew, creating undesirable smells and destroying the carpeting. Unsightly water stains on the carpeting material are another unwanted product of such water flooding. Water damage to the carpet padding, which is typically formed of foam rubber material, results in the destruction of the carpet padding.

Further, water on a plain floor without carpeting, creates a serious hazard for persons who must walk over the floor because the presence of the water covering a bare floor creates an extremely low coefficient of friction as between the floor and the shoe or foot of the person walking therein over.

No similar device known to the Applicant herein incorporates the unique combination of features and characteristics embodied in the unique earthquake-proof support structure for a bottled water holder and dispenser as taught and disclosed in the Application for Letters Patent herein.

The following prior art patents were discovered as a result of a patent search requested by the inventor.

U.S. Pat. No. 4,646,944 (Sanderson) relates to a liquid dispensing apparatus 4 for use in combination with rigid or semi-rigid inverted liquid containers 2. This apparatus comprises a base portion 6 which provides a stable platform for the combination. The base portion 6 contains a fluid seal coupling 14 for effectuating a fluid sealing connection with the neck of the open liquid container 2 and provides an opening into which the liquid is discharged. A spigot 26 incorporating a valve 28 is in communication with the base portion 6. A stabilizing arm 30 extending from the base portion 6 contacts the bottom of the inverted liquid container 2, and, in conjunction with the coupling 14, secures the liquid container to the liquid dispensing apparatus.

U.S. Pat. No. 5,232,188 (Troncone) discloses a mixing pail jig comprises a ring 10 with a U-shaped foot 12 which supports the jig on a floor (substrate 14). A pair of diametrically-opposed feet 20 are secured to the ring 10 for supporting the pail 16 when the pail 16 is inserted into the jig. The jig can be easily moved by a workman to any desired location, and is employed to securely hold a conventional bucket or pail 16 in such a manner that inhibits relative rotation between the jig and the pail 16.

U.S. Pat. No. 4,955,573 (Horvath) relates to a water heater safety fastener which includes a collar adapted to securely fasten a vertically disposed holding tank in the form of a water heat 11 to the wall 7 of the structure surrounding the tank 11. The two-piece collar is formed of a non-flexible, rigid supporting strap 3 which is attached to the surrounding wall 7 by a pair of rigid supporting legs 2 and a flexible supporting strap or outer collar 1.

U.S. Pat. No. 5,131,133 (Peterson, et al.) describes a new and unique water heater support system 10 and related methods which protects the water heater 12 from sustaining earthquake damage. The horizontally-directed segment or member or foot bar 42 of the main support frame 32 of a support bracket 30 is secured to the floor 28 by two fastener assemblies 44. The vertical arm portion 46 of the main support frame 32 is disposed adjacent to the vertically-disposed cylindrical exterior 18 of the water heater 12. A secondary or side-support frame 34 is joined to one another at connection site 36 and is used in combination with the main support frame 32. The lower end of the side support brace 34 is secured via bearing or foot plate 38 to the floor 28. The main support frame 32 is connected to the water heater 12 via a vertical component or member 46 by use of two tight steel bands, top band 48 and lower or bottom band 50. The resulting structure prevents the water heater tank from tipping over during an earthquake.

U.S. Pat. No. 5,310,156 (Matsumura, et al.) relates to an earthquake-proof leg support structure 10 of electronic apparatus. The invention disclosed by Matsumura, et al. describes an earthquake-proof leg support structure 10 of an electronic apparatus, such as a computer, placed on a floor, in which a plurality of legs 12 extend downwardly from an outer case of such electronic apparatus extending from the outer case of an electronic apparatus. As the electronic apparatus is laterally moved by the jolt of an earthquake, the end of the supporting leg 12 moves laterally within a leg support seat 20. Since such lateral movement of the legs 12 is permitted, the likelihood of tip over of the electronic apparatus is minimized. Should the earthquake produce forces causing such lateral movement to move the leg(s) up to the peripheral flange 24 of the leg support seat 20, the leg(s) will cause the leg support seat 20 to move relative to the floor 4 so that the electronic apparatus is prevented from falling over, which might occur when the horizontally moving electronic apparatus is suddenly stopped at the leg 12 thereof.

The present invention provides a much desired solution to a long-felt needs for a sturdy and stable earthquake-proof system for supporting a water bottle holder and dispenser combination, which is commonly referred to as a "water cooler".

SUMMARY OF THE INVENTIONS AND OBJECTS

Fundamentally, the present invention disclosed and described herein is an earthquake-proof support structure for securing a bottled beverage container holder and dispenser above a floor, including a shelf for supporting a bottled beverage container holder and dispenser, at least three legs secured to the shelf extending above and below the shelf for supporting the shelf above a floor, and straps with interlocking buckles for securing the beverage bottle to the support structure to restrict horizontal movement between the shelf and the beverage bottle, and fasteners for securing a leg to a building wall or to another support structure. The three legs are secured peripherally about the shelf to provide maximum stability for the support structure for the bottled beverage container holder and dispenser. The straps are secured by fasteners, or straps, to a wall or another structure for support to restrict movement of the support system both horizontally and vertically to prevent tip-over of the structure and spillage of the beverage during an earthquake. Additional shelves can be added to the support structure as desired for storing additional bottles filled with a beverage for later use or for storage of empty bottles for later pickup and replacement by the bottled water or beverage delivery route driver.

It is a primary object of the present invention to provide a means for securing a beverage container holder and dispenser to a wall or other support structure in order to restrict movement of the support system both horizontally and vertically.

Another primary and important object of the present invention is to prevent tip-over of the structure and spillage of the beverage during an earthquake.

A yet still further and primary object of the instant invention is to provide an earthquake-proof, liquid-dispensing mechanism with a liquid-holding container support mechanism which is simple to manufacture and pleasing to the eye.

A further object of the present invention resides in the combination of supporting legs disposed beneath a supporting platform upon which the bottled beverage container and dispenser rests and extending above such supporting platform to effectively form a cage about the bottled beverage container and dispenser to restrict the horizontal movement thereof.

Another important and primary object of the instant invention is to provide an earthquake-proof support system for vertically-arranged bottled water dispensing systems which are flexibly adaptable for removable securement to other support structures such as building walls, desks, and the like.

One important and primary object of the invention herein is to provide an earthquake-proof support system for water bottle support structures which permit stacking of the water bottles in the water bottle storage and water dispensing system.

Another primary and significant feature of the present invention is to provide for a system which is child safe, in that, it will not tip over if assaulted by a small child.

A major and primary object of the instant invention is to provide such an earthquake-proof structure of the character disclosed and described herein which occupies a minimum amount of floor space.

One very important and significant feature of the invention is that it securely holds the beverage or water bottles.

A yet still further primary and important object and feature of the invention described and disclosed herein is that the water reservoir and dispenser is restricted with respect to horizontal movement relative to the earthquake-proof support system for vertically-arranged bottled water dispensing systems.

These, together with the various ancillary objects and features of the invention which will become apparent as the following description proceeds, are attained by this earthquake-proof support system for a bottled beverage container and dispenser, the preferred embodiments thereof being shown in the accompanying drawings, by way of example only, wherein there is shown and described a preferred form of the present invention:

BRIEF DESCRIPTION OF THE DRAWINGS

FIG. 1 is a front vertical elevational view of the instant invention.

FIG. 2 is a top view of the base of the present invention.

FIG. 3 is a top view of one of the water dispensers used in combination with the present invention.

FIG. 4 is a side elevational view of the base support brace of the present invention.

FIG. 5 is a side elevational view of one of the water dispenser shown and illustrated in FIG. 3.

FIG. 6 is a view of the typical Nylon belt or strap with interconnecting buckle/release mechanism.

DESCRIPTION OF THE PREFERRED EMBODIMENT

Figure 9:
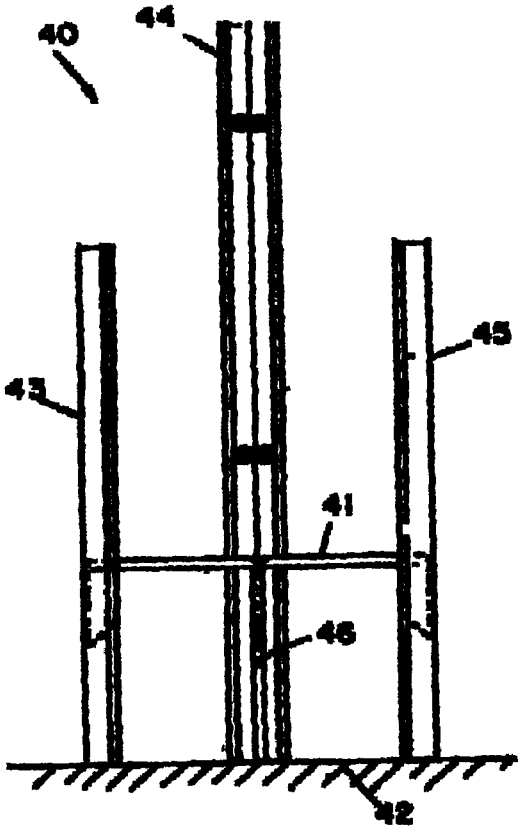
FIG. 9 is a front, vertical elevational view of the embodiment of the invention depicted in FIGS. 7 and 8.

With continued reference to the drawings herein, and with special emphasis now on FIG. 1, there is shown and illustrated an earthquake-proof beverage bottle support and storage structure, generally indicated at 10, for securing a bottled beverage container holder and dispenser 11 above a floor 12, including a shelf 13 for supporting a bottled beverage container holder and dispenser 11, at least three legs 14, 15, 16 secured to the shelf 22 for supporting the shelf 22 above a floor 12, and at least one strap 33 attached to one of the legs 15 and wrapped about the bottle to prevent horizontal movement between the bottle and the bottle beverage container holder and dispenser 11 and fastening means, such as screws or other straps (not shown), for securing the shelf 13 and legs 14, 15, 16 to a wall (not shown) or to another structure, such as a desk (not shown), for support.

With special emphasis now on FIGS. 1 and 2, there is shown in FIG. 1, one shelf 22, although a plurality of identical shelves (not shown) can be vertically disposed above and below shelf 22. Shelf 13 is used to support the combination of the bottled beverage holder and dispenser 24 and the beverage bottle 25. The beverage dispenser 24 also incorporates a spigot 26. Each of the shelves 13, 22 and 23 are so constructed and secured to each of the three legs 14, 15 and 16 so that the weight of both the beverage bottle 25 and a bottled beverage holder and dispenser 24 are supported thereon. With this in mind, each of the shelves 13, 22 and 23, are additionally supported by a shelf support brace of which there are three, that is, one shelf support brace for each of the shelves 13, 22 and 23. The shelf support brace 28 corresponds to shelf 22, and additional braces (not shown) correspond to additional shelves (not shown). Each of the shelf support braces 27, 28 and 29 are, as shown typically in FIG. 4, secured to the respective shelf, here shelf 23, by a plurality of wood screws 30. Additionally, the rear portion of the shelf support brace 29 is secured to the vertically-disposed leg 15 by a plurality of wood screws 31.

It should be noted that typically the liquid beverage in the bottle is simply water; hence, throughout this Specification, the use of the word "water" is intended by the inventor to be restrictive in any sense to actually water per se, but is intended to apply equally to liquid beverages in general as well.

Also, it should be clearly noted that the three legs 14, 15 and 16 are arranged to extend both above and below the shelves 13, 22 and 23. The three legs 14, 15 and 16 extend above the shelves 13, 22 and 23 in order to prevent any horizontal movement between the bottled water holder and dispenser 24 and the shelf 13 on which it is situated.

The three legs 14, 15 and 16 are each formed having an L-shaped cross-section, with the inside of the corner of the L facing towards the center of the shelves 13, 22 and 23. The L-shaped cross-section not only improves the rigidity of the entire structure 10, but also mates with the corner 21 of the bottled water holder and dispenser 24 to prevent horizontal movement between the bottled water holder and dispenser 24 and the shelf 13 on which the bottled water holder and dispenser 24 rests. Rubber or elastomeric standoffs 51, 52 and 53 are respectively mounted on the inside of the arms of the L-shaped cross-section on legs 16, 14 and 15, respectively, to provide miniature bumper-type standoffs between the legs 16, 14 and 15 and the corners 50, 49 and 21 of the bottled water holder and dispenser 24 to ensure a snug-fit therebetween and to prevent relative horizontal movement therebetween.

The bottled water holder and dispenser 24 is shown in FIG. 4 is side elevational form. A top view of the bottled water holder and dispenser 24 is shown and illustrated in FIG. 3, along with the spigot 26 for dispensing the water or beverage therefrom. The top of the bottled water holder and dispenser 24 includes a circular opening with a rim 32. The diameter of the rim about the circular opening is smaller in diameter than the diameter of the water bottle 25 in order to receive and support the water bottle 25 following the removal of the cap of the water bottle 25 and inversion of the water bottle 25 to allow the water to flow from the water bottle 25 into the water reservoir formed by the bottled water holder and dispenser 24. Once inverted, the water bottle 25 is supported by the rim 32 of the bottled water holder and dispenser 24. As water is dispensed from the water reservoir formed by the water dispenser 24 from the spigot 26, the water is automatically, by atmospheric pressure, allowed to flow from the inverted water bottle 25 into the water reservoir of the water dispenser 24 thereby replenishing the water dispensed from the spigot 26.

The other shelves 22 and 23 are used to store additional water bottles, whether full or empty. In fact, in using 3 gallon and 5 gallon water bottles relative to the earthquake-proof support structure, generally indicated at 10, for holding a bottled beverage container holder and dispenser 11, up to 20 gallons of beverage or water can be stored in only one square foot of floor space in a room having a eight foot high ceiling.

With referenced now especially to FIG. 6, there is shown a belt or strap 33 typically formed from a one inch wide Nylon braided belt material which is secured to one or more of the legs (here it is shown secured to leg 15 of the floor-mounted, free-standing bottled beverage container holder and dispenser 11.) At each of the ends of this strap 33 are complementary fasteners, one male 35 and one female 34, for interlocking the ends of the strap 33 to one another, thereby forming a continuous loop. This continuous loop is slightly larger than the outer circumference of the water bottle 25 so that when the water bottle 25 is placed in the water dispenser 24 and the strap 33 fitted thereabout, the ends of the complementary fasteners 34 and 35 can be joined together to form a snug-fit thereabout, securely holding the water bottle 25 in a fixed position relative to the bottled beverage container holder and dispenser 11.

Turning now again to FIG. 1, adjustable levelers 36 are mounted on the bottom of each of legs 14, 15 and 16. Each of the adjustable levelers 36 are vertically adjusted so that the water bottle 25 and water dispenser 24 are level.

One or more of the legs 14, 15 and 16 are secured to a building wall by fasteners such as lag bolts, expanding wall anchoring bolts, or the like. In the even that a building wall is not available, one or more of the legs 14, 15 and 16 can be fastened to a larger support structure such as a desk 20. Typically, when the bottled beverage holder and dispenser 11 is secured to a vertically-disposed building wall for support, rubber or elastomeric standoffs 37 and 38 are mounted on the leg 16, as shown in FIG. 1, to ensure that the spacing between the wall and the leg 15 remains fixed and to absorb shock in the event of an earthquake. Such standoffs 37 and 38 are readily mounted to the leg 15 by either gluing or fastening by using wood screws 39, or the like.

In the configuration of the present invention depicted in FIG. 1, three water bottles can be stored and supported. One is supported by shelf 13, another by shelf 23 and the last one by shelf 22. Once all of the water from the water bottle 25 which is shown mounted on the water dispenser 24 is consumed, it is removed, another water bottle taken down from either shelf 22 or 23, the cap removed and the water bottle inverted and mounted to the water dispenser 24 for use. The empty water bottle can now be stored on the shelf from which it was removed, either shelf 22 or 23, where it will typically remain until replaced with a full water bottle by the bottled water delivery person.

Figure 8:
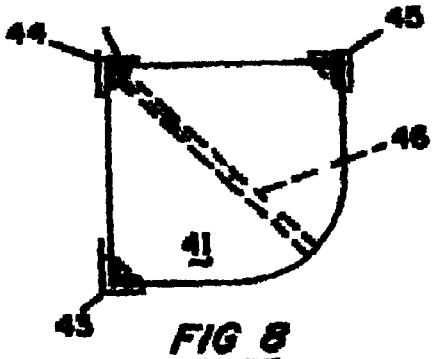
FIG. 8 is a plan view of the embodiment of the present invention depicted in FIG. 7.
Figure 7:
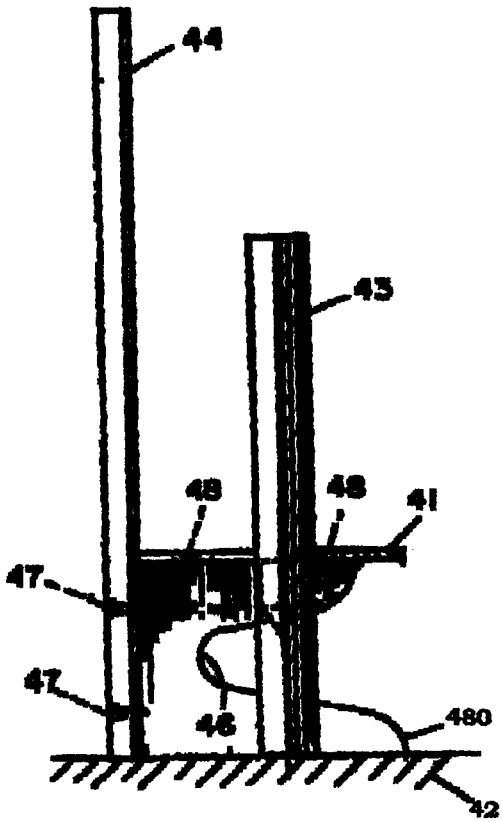
FIG. 7 is a view of another embodiment of the present invention shown on top of a desk or table.

A further embodiment of the invention is depicted in FIG. 8 in the form of a counter-top version, generally depicted at 40, mounted on a counter-top 42. A shelf 41 is provided for supporting the combination of the water dispenser 24 and the water bottle 25. The shelf 41 is mounted to each of the three legs 43, 44 and 45 and to a shelf brace 46 by a plurality of screws 48, which, in turn, is secured to the rear-ward most leg 44, by screws 47, or the like. As shown, the counter-top version 40 of the invention, uses a shelf brace 46 with a foot 100 to add further support and stability to the overall structure and combination. A top view of the counter-top version of the invention is shown in FIG. 9. FIG. 9 depicts a center leg extension to support an additional bottle of water at the top of the inventive structure 40.

It is understood that the present invention is not limited to the particular construction and arrangement of parts disclosed and illustrated herein, but encompasses all such modified forms thereof as come within the scope of the following claims:

I claim as my invention:

1. An earthquake-proof support system for securing a bottled beverage container and a bottled beverage container holder and dispenser above a floor, comprising:

a. shelf means for supporting a bottled beverage container holder and dispenser;

b. leg means secured to said shelf means for supporting said shelf means above a floor, said leg means extending above and below said shelf means, wherein said leg means consists of three legs having portions disposed below said shelf means;

c. strap means secured to said leg means for removable securement about a bottled beverage container, wherein said strap means consists of a pair of flexible straps secured to a middle leg, one of said straps being secured to a portion of said leg disposed below said shelf means, and said other strap being secured to a portion of said leg disposed above said shelf means.

2. An earthquake-proof support system, for securing a bottled beverage container and a bottled beverage container holder and dispenser above a floor, comprising:

a. shelf means for supporting a bottled beverage container holder and dispenser;

b. leg means secured to said shelf means for supporting said shelf means above a floor, said leg means extending above and below said shelf means;

c. strap means secured to said leg means for removable securement about a bottled beverage container;

d. a second shelf means disposed above said shelf means, for supporting a second beverage bottle; and e. second strap means secured to said leg means for removable securement about the second beverage bottle on said second shelf means.

3. The earthquake-proof support system of claim 2, including a third strap means secured to said leg means below said shelf means for removable securement about a third beverage bottle disposed below said shelf means.

4. An earthquake-proof support system for securing a bottled beverage container and a bottled beverage container holder and dispenser above a floor, comprising:

a. shelf means for supporting a bottled beverage container holder and dispenser;

b. leg means secured to said shelf means for supporting said shelf means above a floor, said leg means extending above and below said shelf means;

c. strap means secured to said leg means for removable securement about a bottled beverage container;

d. at least one elastomeric standoff disposed between said leg means to maintain a spaced apart relationship between said leg means and the wall or other support structure and to serve as a shock absorber therebetween.

5. An earthquake-proof support system, for securing a bottled beverage container and a bottled beverage container holder and dispenser above a floor, comprising:

a. shelf means for supporting a bottled beverage container holder and dispenser;

b. leg means secured to said shelf means for supporting said shelf means above a floor, said leg means extending above and below said shelf means, said leg means consisting of three legs having portions disposed below said shelf means, and said leg means consisting of elongated members having at least one L-shaped cross-section;

c. strap means secured to said leg means for removable securement about a bottled beverage container;

d. rubber bumper and spacing means secured to the inside of said leg means and disposed between said leg means and the bottled beverage container holder and dispenser.

* * * * *